US005598779A

United States Patent [19]

Haas et al.

[11] Patent Number: 5,598,779

[45] Date of Patent: Feb. 4, 1997

[54] SHEET GUIDING APPARATUS FOR A TURNING DEVICE IN A ROTARY PRINTING MACHINE FOR FACE-PRINTING AND/OR PERFECTING

[75] Inventors: Hanns-Otto Haas, Heusenstamm; Ingo Kobler, deceased, late of Anhausen, by Heidemarie Köbler, Janine Köbler, Nadine Köbler, Kerstin Köbler, administratrices; Klaus Wolf, Oppenweiler; Peter Mayer, Muhlheim; Josef Mathes, Offenbach; Fred Spies, Muhlheim; Stephan Kanzler, Langen, all of Germany

[73] Assignee: MAN Roland Druckmaschinen AG, Offenbach, Germany

[21] Appl. No.: 536,427

[22] Filed: Sep. 29, 1995

[30] Foreign Application Priority Data

Sep. 29, 1994 [DE] Germany ..... 44 34 778.2

[51] Int. Cl.[6] ..... B41F 5/02

[52] U.S. Cl. ..... 101/230; 101/231; 101/409; 101/183; 271/196

[58] Field of Search ..... 101/232, 231, 101/229, 230, 409, 183; 271/195, 194, 196, 197

[56] References Cited

U.S. PATENT DOCUMENTS

| | | | |
|---|---|---|---|
| 4,127,265 | 11/1978 | Wirz et al. | 271/196 |
| 4,165,689 | 8/1979 | Giuiuzza | 101/230 |
| 4,395,949 | 8/1983 | Jeschke | 101/231 |
| 4,414,896 | 11/1983 | Fischer | 101/230 |
| 4,572,071 | 2/1986 | Cappel et al. | 101/231 |
| 4,790,244 | 12/1988 | Otfried et al. | 271/196 |
| 5,186,107 | 2/1993 | Wieland | 101/409 |
| 5,419,254 | 5/1995 | DeMoore et al. | 101/183 |
| 5,476,041 | 12/1995 | Czotscher | 101/232 |

FOREIGN PATENT DOCUMENTS

| | | |
|---|---|---|
| 0306684B1 | 7/1988 | European Pat. Off. . |
| GM 6949816 | 6/1972 | Germany . |
| 2354418B2 | 10/1975 | Germany . |
| 3411029C2 | 10/1987 | Germany . |

*Primary Examiner*—Eugene H. Eickholt
*Attorney, Agent, or Firm*—Leydig, Voit & Mayer, Ltd.

[57] ABSTRACT

A sheet-guiding apparatus for a turning device in a rotary printing machine guides a sheet being printed to prevent smearing. The turning device includes a turning drum and at least one sheet-guiding cylinder. The turning drum and the sheet-guiding cylinder define a sheet transfer region and a sheet transfer path. The sheet-guiding apparatus comprises an air blower means, at least one blower/suction device, and a lower sheet-guiding device. The air blower means, which is arranged upstream of the sheet transfer region, includes a first set of air outlet openings for directing compressed air toward the sheet-guiding cylinder and at least a second air outlet opening for directing compressed air into the transfer region. The blower/suction device, which is disposed within the sheet-bearing surface of the turning drum, communicates with a plurality of openings disposed in the sheet-bearing surface and is coupled to a pneumatic device. The lower sheet-guiding device is disposed below the sheet transfer path and is switchable between providing compressed air and providing air suction. The air blower means, blower/suction device, and the lower sheet-guiding device cooperate to provide a combination of air blow and suction for guiding the sheet in the sheet transfer process.

10 Claims, 1 Drawing Sheet

SHEET GUIDING APPARATUS FOR A TURNING DEVICE IN A ROTARY PRINTING MACHINE FOR FACE-PRINTING AND/OR PERFECTING

FIELD OF THE INVENTION

The invention relates generally to a sheet guiding device in a rotary printing machine, and more particularly to a sheet guiding apparatus for a turning device in a rotary printing machine designed to perform face-printing or both face-printing and perfecting.

BACKGROUND OF THE INVENTION

In a rotary printing machine adapted for perfecting, a turning device is required to turn the sheet being printed after one side of the sheet has been printed so that the other side of the sheet can be printed. A turning device, for example, may comprise a turning drum and at least one sheet-guiding cylinder, which are arranged upstream (in the sheet running direction) between two printing units. A sheet turning device of this type is disclosed in German Patent DE-AS 2,354,418. In the printing machine disclosed therein, three drums are arranged between two printing units for sheet transfer. One of the three drums which is assigned to the downstream printing unit is designed as turning drum for turning sheets. Arranged upstream of the turning drum is a transfer drum which has air flow channels arranged axially on its circumference at a predefined interval. The flow channels are groove-like and are used to provide air suction. This arrangement is intended to serve the purpose of resting the sheet tautly but without tension on the transfer drum so that the sheet can be transferred in registry to the turning drum. The turning drum and the transfer drum are not provided with any device for guiding the sheet to avoid smearing of the trailing section of the sheet which is hanging free during the sheet turning phase.

German Patent DE-GM 6,949,816 discloses a sheet transfer cylinder on which a sheet is held by grippers at the beginning and end of the sheet. The sheet is held firmly on the transfer cylinder by air suction effected by negative air pressure on the circumference of the sheet transfer cylinder. The sheet is thus intended to rest flat on the cylinder and be pulled toward the end of the sheet to keep it smooth. The sheet transfer cylinder of this type is unsuitable for guiding a freely hanging printed sheet, because of its arrangement of grippers for gripping the trailing edge of the sheet.

A device for pressing a sheet flat on an impression cylinder is described in European Patent Document EP 0,306,684 B1. After a sheet passes the printing zone, it is guided on the impression cylinder by means of compressed air in the region between the printing zone and the transfer region of a downstream turning drum.

German Patent DE 3,411,029 C2 discloses a sheet guiding device which provides a continuous guiding surface. The sheet-guiding device has air nozzles connected to air flow channels. German Patent Document DE 4,140,763 A1 discloses a sheet guiding device which raises the leading edge of a sheet from the impression cylinder during the turning phase by means of compression air and guides the front part of the sheet on a guiding wiper.

The arrangements described above for sheet-guiding have the disadvantage that during the turning phase in which the sheet undergoes a reversal of movement, no effective means is provided to convey the printed sheet from the upstream sheet-guiding cylinder, such as an impression cylinder or a supply drum, to the turning drum without smearing the imprinted image on the sheet.

OBJECTS AND SUMMARY OF THE INVENTION

Accordingly, it is a primary object of the invention to provide a sheet-guiding means which guarantees smearing-free sheet transfer in a rotary printing machine designed to perform face-printing or both face-printing and perfecting.

In accordance with this and other objects of the invention, there is provided a sheet guiding apparatus for a turning device in a rotary printing machine designed to perform face-printing or both face-printing and perfecting. The turning device, which is arranged upstream in the sheet running direction between two printing units of the rotary printing machine, includes a turning drum with sheet gripping systems and at least one sheet-guiding cylinder disposed immediately upstream of the turning drum. The turning drum and the upstream sheet-guiding cylinder defines a sheet transfer region and a sheet transfer path. The turning drum has sheet gripper systems arranged therein and at least one sheet-bearing surface. The sheet-guiding apparatus of the present invention comprises an air blower means, a blower/suction device and a lower sheet guiding device. The air blower means, which is arranged ahead of the transfer region, includes a first set of air outlet openings which directs compressed air toward the sheet guiding cylinder and a second air outlet opening which directs compressed air into the transfer region in a direction which is substantially tangential to both the sheet guiding cylinder and the turning drum. The blower/suction device, which is disposed inside the sheet-bearing outer surface of the turning drum, communicates with a plurality of air openings disposed in the sheet bearing surface and is coupled to an air supply unit. The lower sheet guiding device, which is disposed below the sheet transfer path, is selectively switchable between providing compressed air flow and providing suction air flow.

Other objects and advantages will become apparent from the following detailed description when taken in conjunction with the drawings, in which:

DETAILED DESCRIPTION OF THE PREFERRED EMBODIMENT

Figure 1:
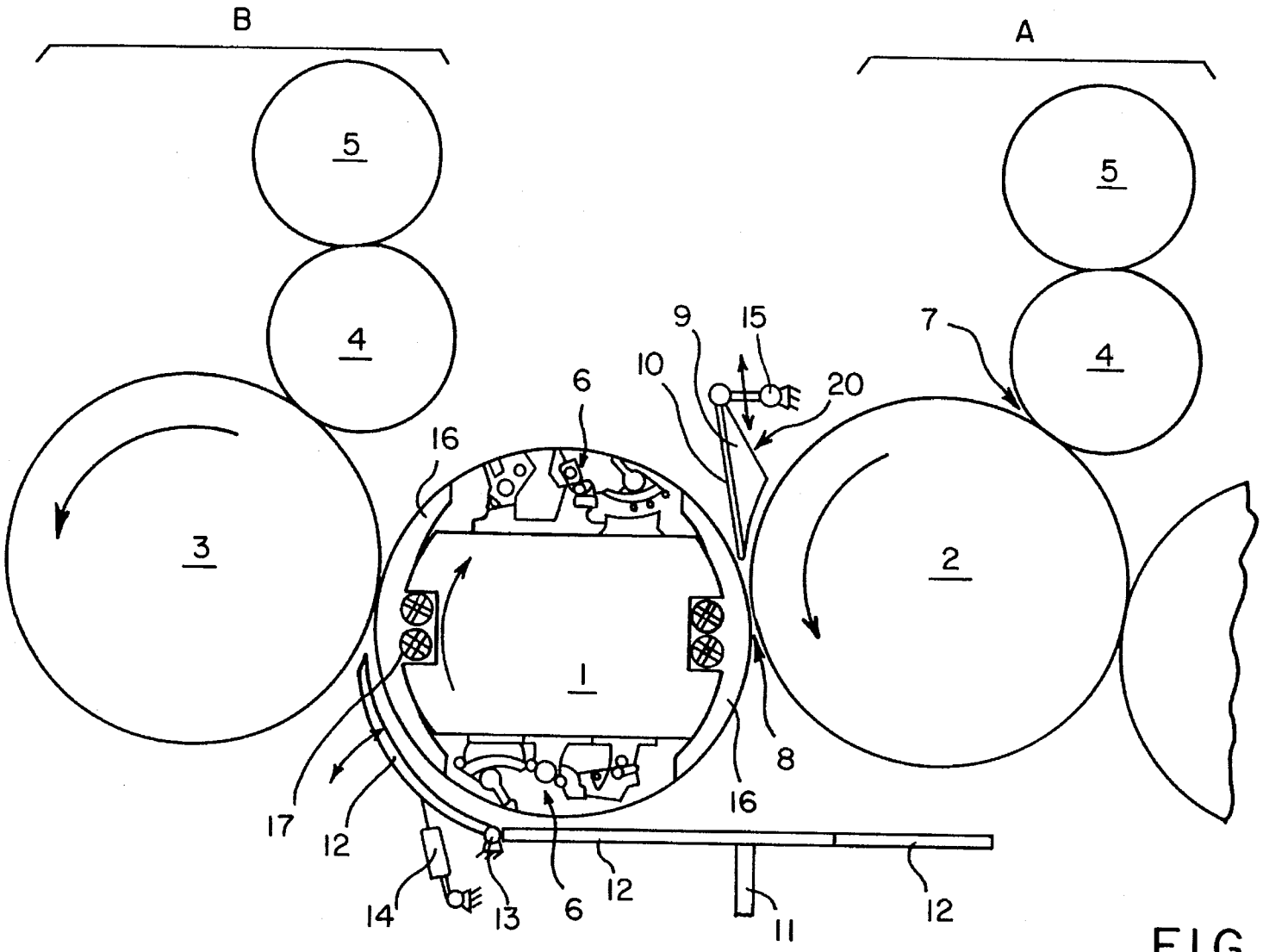
FIG. 1 is a schematic drawing showing a turning device and the sheet-guiding apparatus of the present invention in a rotary printing machine designed for face-printing or both face-printing and perfecting.

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

Turning now to the Figure, FIG. 1 is a schematic drawing showing a section of a printing machine with a turning device and the sheet-guiding apparatus according to the teaching of the invention. A turning drum 1 is arranged between two printing units A and B. The printing unit A, which is disposed upstream in the sheet-running direction, comprises in a well known manner an impression cylinder 2, a blanket cylinder 4, and a plate cylinder 5. The printing unit B, which follows the turning drum, likewise comprises an impression cylinder 3, a blanket cylinder 4', and a plate cylinder 5'. For simplicity of illustration, details that are unimportant for illustrating the present invention, such as the inking and damping units associated with the plate cylinders 5 and 5', are not shown in FIG. 1.

In the embodiment of the printing machine in FIG. 1, the sheet-guiding cylinders are the impression cylinders 2 and 3 which, as illustrated, are of double-size construction. The turning device comprises the sheet-guiding cylinder 2 of the upstream printing unit A and the turning drum 1. The turning drum 1 in FIG. 1 is also shown to have a double-size construction. Each half of the turning drum bears a gripper device 6, and the two gripper devices 6 on the turning drum 1 are arranged 180° apart. The gripper device 6 comprises, in a known manner, a suction system, a leading edge sheet gripper system and a trailing edge sheet gripper system with corresponding gripper pads.

The sheet-guiding apparatus of the present invention as shown in FIG. 1 comprises an air blower means 20, two blower/suction devices 16 integrated in the turning drum 1, and a lower sheet-guiding device 12. The air blower means 20 is disposed adjacent to and above the impression cylinder 2 and extends over its axial length. In the sheet-running direction, the air blower means 20 is positioned after a printing zone 7 between the impression cylinder 2 and the blanket cylinder 4, but ahead of a transfer region 8 between the impression cylinder 2 and the turning drum 1. In order to guide the sheet on the impression cylinder 2, the sheet is pressed flat against the surface of the impression cylinder 2 by compressed air which is blown through a first set of air outlet openings 9 of the air blower means 20. The first set of air outlet openings 9 is adapted to the contour of the impression cylinder 2 and extends up to the transfer region 8. The air blower means 20 also has at least a second air outlet opening 10 which is separate from the first set of air outlet openings 9. The second air outlet opening 10 is directed into the transfer region 8 in a direction tangential to both the impression cylinder 2 and the turning drum 1. The intensity of the compressed air blown through the air outlet opening 10 is higher than the intensity of the compressed air blown through the first set of outlet openings 9, which are directed towards the impression cylinder 2. Because the first set of air outlet openings 9 and the second air outlet opening 10 are operated at different air intensities, preferably the air blower means 20 has two separate feed lines connected to two different supply units. Because the air blower means 20 is not used in face-printing, preferably the air blower means 20 is mounted on a pivotal mounting means so that it can be pivoted out of the transfer region 8. For example, as shown in FIG. 1, the air blower means 20 is mounted on a rotary joint 15.

Two sheet-bearing outer surfaces are arranged on the circumference of the double-size turning drum 1 between the gripper devices 6. These outer surfaces are formed by two blower/suction devices 16 which are disposed in the turning drum 1. Each outer surface on the drum circumference has a plurality of air openings in the form of, for example, bores, which are preferably arranged at a regular interval. Each blower/suction device 16 is coupled to an air supply unit. The air supply unit consists, for example, of fans 17 arranged in the turning drum 1. Alternatively, the air supply unit can be an external air supply which is preferably coupled to the blower/suction devices 16 via a rotary air coupling connected to the transfer drum. Those skilled in the art will appreciate, however, that other types of air supply can be used without departing from the scope and spirit of the invention.

In the preferred embodiment of the invention, each blower/suction device 16 on the turning drum 1 is subdivided into a plurality of chambers which can be switched individually or in pairs between the operation states of air blowing and suction.

A lower sheet-guiding device 12 is arranged below the sheet transfer path between the turning drum 1 and the impression cylinder 2 of the upstream printing unit A. According to the invention, the lower sheet-guiding device is adapted to be switchable between providing compressed air and providing air suction. Preferably the lower sheet guiding device has a plurality of upwardly directed air openings which are coupled to an air supply. As shown in FIG. 1, the lower sheet-guiding device 12 is connected via a line system 11 to an external air supply source (not shown). The lower sheet-guiding device 12 has a pivotable downstream section 12' which is disposed along to the ascending part of the sheet transfer path. The downstream section 12' of the lower sheet guiding device 12 receives its supply of air via fans. As will be described below, the position of the downstream section 12' in the face printing mode is different from that in the perfecting mode. A means is therefore provided to move the downstream section 12' between the two different positions associated with the two printing modes. For example, in FIG. 1 the downstream section 12' is mounted on a rotary joint 13 so that it can be pivoted toward or away from the ascending path of the turning drum 2 by means of an actuation cylinder 14.

The operation of the sheet-guiding apparatus in printing operation will now be described. In the perfecting mode, the sheet on the impression cylinder 2 which has been guided through the printing zone 7 is pressed flat against the impression cylinder 2 by means of compressed air from the first set of air outlet openings 9 of the air blower means 20. The sheet is guided in this way until the trailing edge of the sheet enters the transfer region 8. The compressed air from the second air outlet opening 10, which is directed into the transfer region in a direction tangential to both the impression cylinder 2 and the turning drum 1, blows against the trailing edge of the sheet, so that the rear region of the sheet is separated from the impression cylinder. At this point, the sheet has been released by the gripper system of the impression cylinder 2. The trailing edge of the sheet is then gripped by the trailing edge sheet gripper system of a gripper device 6 on the turning drum 1 according to the method of trailing edge turning. The former trailing edge, i.e., the trailing edge of the sheet when the sheet was on the impression cylinder 2, thus becomes the leading edge on the turning drum 1 and is transferred to the downstream impression cylinder 3 for perfecting. The steps of sheet transfer from the impression cylinder 2 to the impression cylinder 3 constitute the turning phase of the printing operation.

The sheet transfer from the impression cylinder 2 to the turning drum 1 in the turning phase is critical since the sheet has to be "peeled off" from the impression 2 within a very short time. After the sheet is gripped by the trailing edge sheet gripper system on the turning drum 1, the former leading edge becomes the freely hanging trailing edge. There is a risk of smearing the downward-facing printed surface on the sagging trailing edge if the sheet is not guided properly. Such a risk of smearing is avoided by the operation of the sheet-guiding apparatus of the invention. As described above, the "peeling-off" of the sheet from the impression cylinder 2 is achieved by the blow of air from the second air outlet opening 10 of the air blower means 20. An air cushion is thus introduced between the peeled-off trailing edge of the sheet and the impression cylinder 2. The air cushion reduces the adhesive force of the sheet and the sliding friction between the sheet and the impression cylinder 2 in the turning phase. To prevent smearing of the downward-facing printed surface, the lower sheet-guiding device 12 blows air against the printed surface of the sheet. At the same time the second air outlet opening 10 of the air blower means 20 continues to blow air through the transfer region 8. As a result, a positive air pressure is maintained on each side of the freely hanging trailing edge of the sheet. In this way the sheet which has been received by the turning drum 1 is guided by means of compressed air. During the continued rotation of the turning drum 1, a suction force is applied on the sheet by the blower/suction device 16 so that the sheet rests on the turning drum 1 with the non-printed surface against the circumference of the turning drum 1. The sheet follows the contour of the circumference of the turning drum 1 and receives a slight convex curvature, which has an additional stabilizing effect on the rear region of the sheet that is still hanging free. The smearing of the printed side of the sheet against the lower sheet-guiding device 12 is avoided by the combination of air flow from the lower sheet-guiding device and the additional stabilizing effect.

It will be appreciated that the sheet-guiding apparatus of the invention can also be used in a printing machine adapted for face-printing. In the face-printing mode, a sheet on the impression cylinder 2 which has been guided through the printing zone 7 is transferred by the leading edge to the turning drum 1 in the transfer region 8. The air blower means 20 which is mounted on the rotary joint 15 is pivoted out of the transfer region 8, so that the face-printing grippers of the gripper device 6 on the turning drum 1 will not collide with the air blower means 20. After being transferred to the turning drum 1, the sheet rests on the turning drum 1 with the printed side facing the circumference of the turning drum 1. To prevent the contact between the printed surface and the surface of the turning drum, the blower/suction device 16 is switched over to provide compressed air, so that an air cushion is formed between the sheet and the outer surface of the turning drum 1. The air cushion prevents the sheet from smearing on the turning drum 1. The lower sheet-guiding device 12 is switched over to provide air suction and the downstream section 12' is pivoted to a position closer to the turning drum 1 than its position in the perfecting mode. As a result, the sheet can be sucked on by the lower sheet-guiding device 12 below the transfer region formed by the turning drum 1 and the downstream impression cylinder 3. A sheet smoothing device which stretches the sheet in the direction opposite to the sheet-running direction can also be arranged at the end of the downstream section 12' of the lower sheet-guiding device 12. As a result, the sheet is spread flat on the impression cylinder 3.

In the embodiment shown in FIG. 1, there is one transfer drum between two adjacent printing units A and B in the printing machine. The turning device includes the turning drum 1 and the impression cylinder 2 of the upstream printing unit. The impression cylinder 2 serves the function of a sheet-guiding cylinder and the air blower means 20 directs compressed air to the impression cylinder 2. It will be appreciated that the sheet-guiding apparatus of the invention can also be used in a printing machine that has three sheet guiding drums between two adjacent printing units. In that case the intermediate supply drum of the upstream printing unit will serve the function of the sheet-guiding drum, and the air blower means 20 of the sheet-guiding apparatus will be assigned to it accordingly.

It will be appreciated now that what has been provided is a sheet-guiding apparatus for a turning device in a rotary printing machine adapted for face-printing or both face-printing and perfecting. The sheet-guiding apparatus comprises an air blower means, at least one blower/suction device, and a lower sheet guiding device, which operate cooperatively to provide a combination of air blow and suction to guide the sheet being printed and to prevent smearing of the printed surface. The sheet-guiding apparatus can be used not only in the perfecting mode in which the sheet is turned over by the trailing edge turning method, but also in the face-printing mode in which the sheet is not turned over.

What is claimed is:

1. Sheet-guiding apparatus for a turning device disposed between two printing units in a rotary printing machine adapted for both face-printing and perfecting printing, said turning device including a turning drum and at least one upstream sheet-guiding cylinder defining a sheet transfer region and a sheet transfer path, said turning drum having both at least one leading edge sheet gripper system disposed thereon for face-printing and sheet transfer and at least one trailing edge gripper system disposed thereon for sheet turning and transfer incident to perfecting printing, and at least one sheet-bearing surface following said gripper systems, said sheet-guiding apparatus comprising, in combination, air blower means disposed upstream of said sheet transfer region, said air blower means including a first set of air outlet openings for directing compressed air toward said upstream sheet-guiding cylinder and at least a second air outlet opening for directing compressed air into said sheet transfer region in a direction substantially tangential to both of said upstream sheet-guiding cylinder and said turning drum;

at least one switchable blower/suction device disposed within said turning drum and communicating with a plurality of air openings disposed in said sheet bearing surface, said blower/suction device including means for selectively blowing and sucking air through said air openings in said sheet bearing surface, and a lower sheet-guiding device disposed below said sheet transfer path, said lower sheet-guiding device having a plurality of upwardly directed air openings and including air source means selectively switchable between providing compressed air flow and providing suction air flow through said plurality of upwardly directed air openings.

2. A sheet-guiding apparatus as defined in claim 1 wherein said air blower means is effective for directing compressed air out through said second air outlet opening at an intensity that is greater than the intensity of the air directed out through said first set of air outlet openings.

3. A sheet-guiding apparatus as defined in claim 1, including pivotal mounting means connected to said blower means for pivoting said blower means away from said transfer region.

4. A sheet-guiding apparatus as defined in claim 1, wherein said blower/suction device is selectively switchable between providing air suction during perfecting printing and providing compressed air during face-printing.

5. A sheet-guiding apparatus as defined in claim 1, wherein said blower/suction device includes at least one fan disposed within said turning drum.

6. A sheet-guiding module as defined in claim 1, including a rotary air coupling connected to said transfer drum and wherein said blower/suction device comprises an air supply unit which is separate from said turning drum and is connected to said rotary air coupling.

7. A sheet-guiding apparatus as defined in claim 1, wherein said blower/suction device is subdivided into a plurality of chambers adapted to be switchable individually or in pairs between the operational states of air blowing or suction.

8. A sheet-guiding apparatus as defined in claim 1, wherein said lower sheet-guiding device has a pivotable downstream section disposed along the sheet ascending path of said turning drum, and including means for selectively pivoting said downstream section toward and away from the ascending path of said turning drum.

9. A sheet-guiding apparatus as defined in claim 1, wherein said sheet turning drum is disposed between said two printing units, and said sheet-guiding cylinder toward which said air blower means is directed is an impression cylinder of the upstream one of said printing units.

10. A sheet-guiding apparatus as defined in claim 1, wherein three sheet guiding drums are disposed between said two printing units, and said sheet-guiding cylinder toward said air blower is assigned is an intermediate supply drum of the upstream one of said printing units.

* * * * *